US006471466B2

(12) United States Patent
Marx et al.

(10) Patent No.: US 6,471,466 B2
(45) Date of Patent: Oct. 29, 2002

(54) FEED PUMP

(75) Inventors: Peter Marx, Wasbüttel; Hans Dieter Wilhelm, Neu--Anspach; Holger Barth, Friedewald, all of (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/811,852

(22) Filed: Mar. 19, 2001

(65) Prior Publication Data

US 2001/0041132 A1 Nov. 15, 2001

(30) Foreign Application Priority Data

Mar. 21, 2000 (DE) ..... 100 13 907

(51) Int. Cl.[7] ..... F04D 5/00
(52) U.S. Cl. ..... 415/55.1; 416/203
(58) Field of Search ..... 415/55.1, 55.5, 415/55.7, 119; 416/175, 203

(56) References Cited

U.S. PATENT DOCUMENTS 3,418,991 A * 12/1968 Shultz et al. ..... 123/179.1
3,881,839 A * 5/1975 MacManus ..... 415/55.1 X
3,947,149 A * 3/1976 MacManus ..... 415/55.1 X
4,678,395 A * 7/1987 Schweinfurther ..... 415/119
4,881,871 A * 11/1989 Wunderlich ..... 415/119
4,923,365 A * 5/1990 Rollwage ..... 415/119
5,017,086 A * 5/1991 Hansen ..... 415/143
5,596,970 A * 1/1997 Schoenberg et al. ..... 123/497
5,681,145 A * 10/1997 Neely et al. ..... 415/119
5,975,843 A * 11/1999 Ebihara ..... 415/119
6,162,012 A * 12/2000 Tuckey et al. ..... 415/55.1

FOREIGN PATENT DOCUMENTS

| | | | |
|---|---|---|---|
| DE | 37 08 336 | 9/1988 | ..... F04D/29/18 |
| DE | 38 11 990 | 10/1988 | ..... F04D/29/66 |
| EP | 0 884 479 | 3/1998 | ..... F04D/5/00 |

* cited by examiner

*Primary Examiner*—Edward K. Look
*Assistant Examiner*—Richard A. Edgar
(74) *Attorney, Agent, or Firm*—Cohen, Pontani, Lieberman & Pavane

(57) ABSTRACT

A feed pump includes an impeller with two rings of guide blades delimiting blade chambers. The rings of guide blades concentrically surrounding one another and have different angular intervals between guide blades. The angular intervals between the guide blades of each ring vary within a range of values and ranges of values of each ring of guide blades is different to avoid the additions of noise emissions the feed pump consequently has noises which cause particularly little disturbance.

7 Claims, 1 Drawing Sheet

FEED PUMP

BACKGROUND OF THE INVENTION

1. Field of the Invention

The invention relates to a feed pump with at least one driven impeller rotating in a pump casing, wherein a plurality of rings of blade chambers are arranged on at least one end face of the impeller, feed channels are arranged opposite the rings of blade chambers in the wall of the pump casing, and guide blades delimit the blade chambers of the impeller.

2. Description of the Related Art

Feed pumps with impellers having plural ring blade chambers are often used for feeding fuel out of a fuel tank in present-day motor vehicles and are known from practice. The known feed pump includes two rings of blade chambers, one concentrically surrounding the other, on a common impeller. When the impeller rotates, the fuel passes via an inlet channel first into a radially inner one of the feed channels and subsequently into a radially outer one of the feed channels. The pump consequently has two pumping stages.

Furthermore, another known feed pump is made with two impellers, each having a ring of blade chambers. In this known device, each impeller forms a pumping stage of the feed pump.

A problem associated with the known feed pumps is that they generate very high noise emissions. The noise emissions create a disturbing whistling sound.

SUMMARY OF THE INVENTION

It is an object of the present invention to provide a feed pump having an impeller with plural rings of blade chambers so that the feed pump generates noise emission causing particularly little disturbance.

The object is met according to the present invention by arranging angular intervals between adjacent guide blades relative to one another and on different rings to vary slightly in each case according to the rules of stochastic distribution, i.e., the angular intervals between successive adjacent guide blades vary by a random amount.

The slight variation in angular intervals between guide blades keeps the noise emissions in each of the rings of guide blades particularly low. Accordingly, none of the rings of guide blades generates a whistling sound. The variation in the angular intervals of the guide blades of the various rings prevents the noise emissions of each guide blade from adding up. The rings of guide blades therefore in each case generate noise emissions at different frequencies. Therefore, the noise emissions of the feed pump according to the present invention are distributed over a wide range of the audible frequency spectrum and are detected by the human ear as a uniform murmur. The feed pump according to the present invention consequently generates noise emissions which cause particularly little disturbance.

According to an embodiment of the present invention, a contribution to the particularly wide distribution of the noise emissions over the audible frequency spectrum is made if the angular intervals of the guide blades of different rings vary in different ranges.

According to another embodiment of the present invention, overlaps of noise emissions of two rings of guide blades which may be generated accidentally due to the variation in the angular intervals, may be avoided in a simple way if the number of guide blades of the different rings varies.

The feed pump according to the present invention has, along with low disturbing noise emissions, particularly high efficiency if the number of guide blades of a radially inner one of two rings is smaller than the number of guide blades in the radially outer one of the two rings.

According to further embodiment of the present invention, noise emissions generated due to the rings of guide blades influencing one another via the fuel to be fed is avoided in a simple way if each feed channel is provided for connection to a specific consumer. For example, one feed channel may lead to a suction jet pump arranged within the fuel tank while the other feed channel is connected to a forward-flowline leading to an internal combustion engine of the motor vehicle. Moreover, one feed channel may be provided for suction intake directly from the fuel tank and the other feed channel for suction intake from a baffle. As a result, the flow of fuel from one ring of guide blades to a further ring is prevented, thereby avoiding the transmission and intensification of the noises within the feed pump.

The feed pump according to the present invention has particularly low noise emissions, along with high efficiency, if the angular intervals of the radially outer ring of guide blades of two rings vary relative to one another in the range of 8° to 12°.

A contribution to a further reduction in the noise emissions of the feed pump according to the invention is made if the angular intervals of the radially inner ring of guide blades of two rings vary relative to one another in the range of 16° to 20°.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
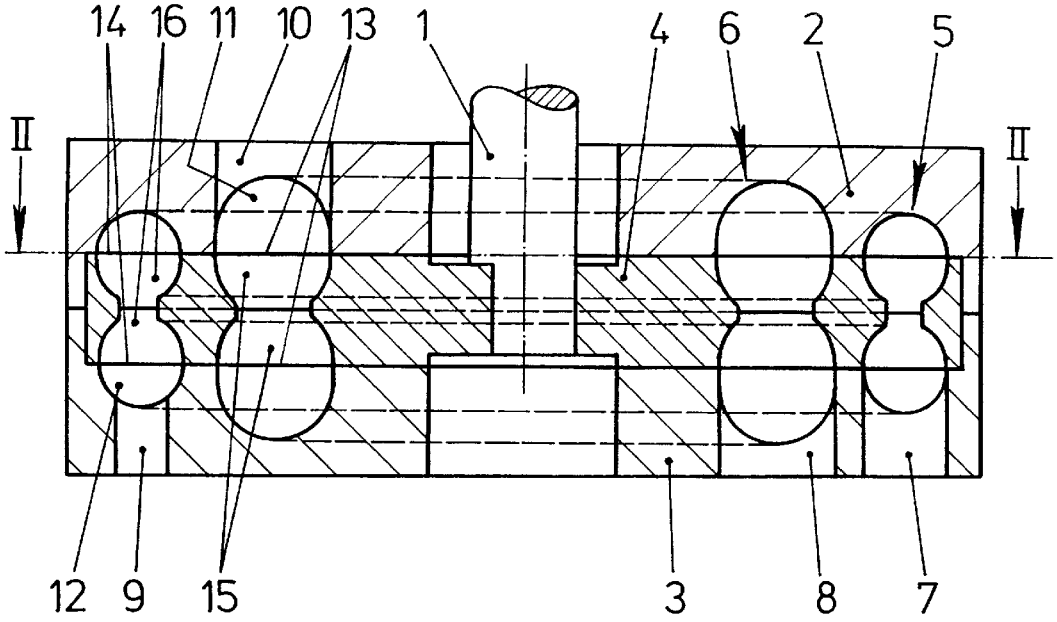
FIG. 1 is an axial sectional view through a feed pump according to an embodiment of the present invention.

FIG. 1 is a sectional view through a feed pump designed as a side-channel pump. The feed pump includes an impeller 4 fastened on a shaft 1 and rotatable between two fixed housing parts 2, 3. The feed pump has two feed chambers 5, 6, one concentrically surrounding the other. The feed chambers 5, 6 respectively extend from an inlet channel 7, 8 as far as an outlet channel 9, 10. Furthermore, the feed chambers 5, 6 are respectively composed of feed channels 11, 12 arranged in the housing parts 2, 3 and of blade chambers 15, 16 arranged in the impeller 4. The blade chambers 15, 16 are delimited by moving blades 13, 14. Each of the blade chambers 15, 16 is arranged as a depression in one of the end faces of the impeller 4. Blade chambers 15 which are located on opposing sides of the impeller 4 and blade chambers 16 located on opposing sides of the impeller 4 are connected to one another. Rotation of the impeller 4 creates circulation flows leading from the inlet channels 7, 8 to the outlet channels 9, 10 in the feed chambers 5, 6.

Figure 2:
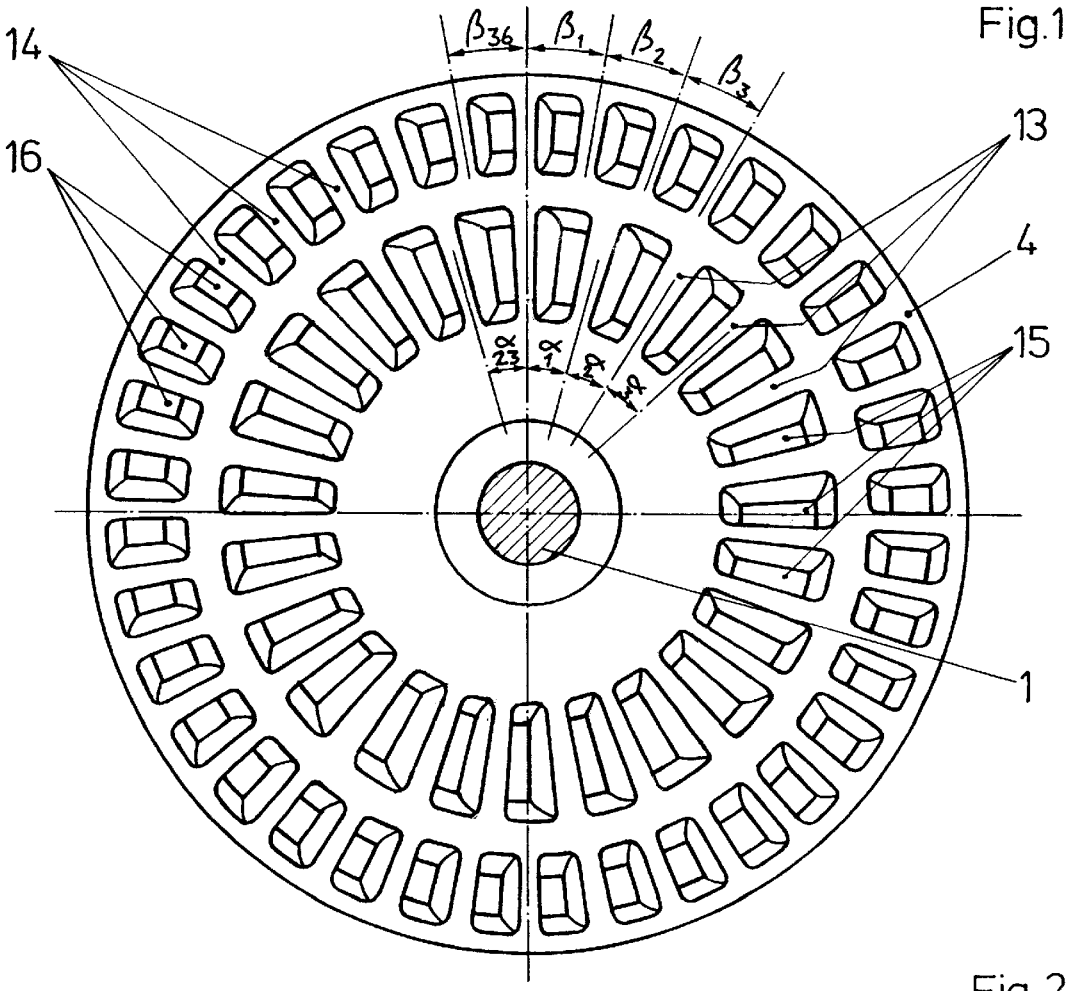
FIG. 2 is a sectional view of the feed pump from FIG. 1 along the line II—II showing one of the end faces of an impeller of the feed pump.

FIG. 2 shows a top view of one of the end faces of the impeller 4 in a sectional view through the feed pump from FIG. 1 along the line II—II. Impeller 4 includes two rings of blade chambers 15, 16. The rings of blade chambers 15, 16 concentrically surround one another such that the blade chambers 15 form a radially inner ring and the blade chambers 16 form a radially outer ring. FIG. 2 also illustrates the angular intervals α and β of the moving blades 13, 14 relative to one another. The angular intervals α of the guide blades 13 of the radially inner ring vary between 16° and 20°. For example, a stochastic, i.e., random, distribution of the angular intervals α1 to α23 is specified for 23 moving blades of the radially inner ring of guide blades 13.

| Angle | Angular interval | Angle | Angular interval | Angle | Angular interval |
|---|---|---|---|---|---|
| α1 | 19° | α9 | 18° | α17 | 18° |
| α2 | 19° | α10 | 17° | α18 | 20° |
| α3 | 18° | α11 | 19° | α19 | 17° |
| α4 | 18° | α12 | 16° | α20 | 18° |
| α5 | 16° | α13 | 18° | α21 | 16° |
| α6 | 18° | α14 | 20° | α22 | 18° |
| α7 | 16° | α15 | 20° | α23 | 17° |
| α8 | 17° | α16 | 18° | | |

The radially outer ring has 36 moving blades 14. The angular intervals β1 to β36 of the moving blades 14 relative to one another vary in the range of between 8° and 12° in a similar way to the stochastic distribution specified for the radially inner ring.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A feed pump, comprising:

a pump housing having at least one wall and an impeller rotatably arranged in said pump housing and having at least one end face;

a plurality of rings of blade chambers arranged on said at least one end face of said impeller;

feed channels arranged in said at least one wall of the pump casing opposite said plural rings of blade chambers on said at least one end face; and guide blades arranged on said impeller and delimiting circumferential ends of said blade chambers, wherein angular intervals between adjacent ones of said guide blades in each of said plural rings of blade chambers vary according to a stochastic distribution.

2. The feed pump of claim 1, wherein the angular intervals of the guide blades of one of the plural rings vary within a first range of angles and the angular intervals of the guide blades of another of the plural rings vary within a second range of angles, said first range being different than said second range.

3. The feed pump of claim 1, wherein a number of guide blades in one of said plural rings of blade chambers is different from a number of guide blades in another of said plural rings of blade chambers.

4. The feed pump of claim 1, wherein said plural rings of blade chambers comprises a radially inner ring and a radially outer ring and a number of guide blades in said radially inner ring is smaller than a number of guide blades in said radially outer ring.

5. The feed pump of claim 1, wherein each of said feed channels corresponds to a respective one of said plural ring chambers and is connected to a specific consumer.

6. The feed pump of claim 1, wherein said plural rings of blade chambers comprises a radially inner ring and a radially outer ring, one concentrically surrounding the other, and said angular intervals between said guide blades in said radially outer ring vary relative to one another in the range of 8° to 12°.

7. The feed pump of claim 1, wherein said plural rings of blade chambers comprises a radially inner ring and a radially outer ring, one concentrically surrounding the other, and said angular intervals between said guide blades in said radially inner ring vary relative to one another in the range of 16° to 20°.

* * * * *